US006648611B2

(12) United States Patent
Morse et al.

(10) Patent No.: US 6,648,611 B2
(45) Date of Patent: Nov. 18, 2003

(54) GEROTOR PUMP HAVING AN ECCENTRIC RING HOUSING WITH AN INTEGRAL PRESSURE CHAMBER

(75) Inventors: David M. Morse, Waterford, MI (US); Jun Yoshioka, Fort Wayne, IN (US)

(73) Assignee: Torque-Traction Technologies, Inc., Holland, OH (US)

( * ) Notice: Subject to any disclaimer, the term of this patent is extended or adjusted under 35 U.S.C. 154(b) by 142 days.

(21) Appl. No.: 09/964,304

(22) Filed: Sep. 26, 2001

(65) Prior Publication Data

US 2002/0012598 A1 Jan. 31, 2002

Related U.S. Application Data

(63) Continuation-in-part of application No. 09/363,737, filed on Jul. 30, 1999.

(51) Int. Cl.[7] ..... F04B 49/00
(52) U.S. Cl. ..... 417/310; 418/171
(58) Field of Search ..... 417/310, 171; 418/171

(56) References Cited

U.S. PATENT DOCUMENTS 3,985,476 A 10/1976 Hofbauer
5,711,408 A * 1/1998 Dick ..... 192/85 R
6,095,939 A * 8/2000 Burns et al. ..... 475/88

* cited by examiner

*Primary Examiner*—Teresa Walberg
*Assistant Examiner*—Vinod D. Patel
(74) *Attorney, Agent, or Firm*—Hahn Loesser & Parks, LLP; Robert J. Clark

(57) ABSTRACT

A gerotor assembly includes a pressure chamber with an integral eccentric ring for a motor vehicle hydraulic differential for use in hydraulic limited slip differentials for axles, transfer case center differentials and similar devices. The gerotor pump assembly in accordance with the present invention includes a housing having an integral ring which provides a pressure chamber for a piston, an eccentrically positioned recess for a inner rotor and an outer rotor and a location for a pressure limiting system. The gerotor pump assembly is of a non-reversing gerotor pump configuration using known methods to produce a unidirectional fluid flow.

20 Claims, 1 Drawing Sheet

GEROTOR PUMP HAVING AN ECCENTRIC RING HOUSING WITH AN INTEGRAL PRESSURE CHAMBER

This application is a continuation-in-part of application Ser. No. 09/363,737 filed on Jul. 30, 1999.

TECHNICAL FIELD

The present invention relates generally to a novel gerotor pump having an eccentric ring housing with an integral pressure chamber for a motor vehicle hydraulic differential. More particularly, the present invention relates to a new eccentric ring housing with an integral pressure chamber for a gerotor pump used in a motor vehicle hydraulic differential which is particularly suitable for use in hydraulic limited slip differentials for axles, transfer case center differentials and similar devices.

BACKGROUND OF THE INVENTION

Gerotor pumps are generally well known and are commonly used in numerous motor vehicle drivetrain subassemblies. In general, gerotor pumps include three (3) main components, an inner rotor, an outer rotor and an eccentric ring. The inner rotor preferably has one less tooth than the outer rotor and has a center line positioned at a fixed eccentricity from the center line of the outer rotor. Conjugately generated tooth profiles maintain substantially continuous fluid-tight contact between the inner rotor and the outer rotor during operation of the gerotor pump. As the inner rotor rotates, liquid is drawn into an enlarging chamber formed by the missing tooth in the inner rotor to a maximum volume which is equal to that of the missing tooth in the inner rotor. Liquid is then forced out of the chamber as the teeth of the inner rotor and the rotor housing again mesh, thereby decreasing the volume of the chamber. In certain applications, the gerotor pump may be configured such that the outer rotor is connected to rotate with a first shaft and the inner rotor is connected to rotate with a second shaft. In such a configuration, no fluid is displaced by the gerotor pump unless the first shaft and the second shaft are rotating at different speeds relative to each other, thereby causing differential rotation of the inner rotor and the outer rotor relative to each other.

One common application of gerotor pumps in motor vehicle drivetrain subassemblies involves utilizing the gerotor pump to provide fluid pressure to actuate a clutch assembly in response to differential rotation between rotating members. Gerotor pumps may also be used in motor vehicle drivetrain subassemblies to circulate lubricating fluid to the various components in the motor vehicle drivetrain assembly. Gerotor pumps generally include an inlet port and an outlet port which are positioned approximately 180 degrees apart. When non-reversing gerotor pumps are utilized, a change in the direction of rotation of the inner rotor relative to the outer rotor causes a reversal in the direction of flow of fluid from the outlet port to the input port. In many motor vehicle applications, it is desirable to use a reversing gerotor pump such that reversal in the relative direction of rotation between the inner rotor and the outer rotor does not cause a corresponding reversal in the direction of fluid flow from the inlet port to the outlet port. This is generally accomplished by positioning the outer rotor within a free-turning eccentric ring. A stop pin is also generally provided to limit rotation of the eccentric ring to 180 degrees in either direction. Changing the eccentricity of a gerotor pump by allowing the eccentric ring to rotate 180 degrees also reverses the direction of fluid flow. Therefore, if upon a reversal of the relative direction of rotation between the inner rotor and the outer rotor in the gerotor pump, the eccentric ring is caused to rotate 180 degrees, the direction of fluid flow will remain unchanged, from the inlet port to the outlet port. In motor vehicle drivetrain subassemblies and other applications involving frequent reversals of a gerotor pump, the reversals will often cause excessive wear on the gerotor pump. Other methods have been developed for unidirectional fluid flow for non-reversible gerotor pumps such as commutators or special valve arrangements.

In applications where the gerotor pump is utilized to provide fluid pressure to actuate a clutch assembly in response to differential rotation between rotating members, a piston housing is typically placed adjacent to the gerotor pump assembly. The piston housing is typically configured with a piston inlet passage, which is generally an aperture through the wall of the piston housing, allowing fluid to enter the piston housing and force a piston against a clutch pack or typical clutch assembly. Problems with this type of arrangement include using additional parts, potential fluid leakage (pressure loss) at the mating register surfaces of the gerotor pump and the piston housing, as well as additional friction forces between the outer rotor and the piston housing such as with reversible gerotor pumps. In addition, these prior art gerotor pumps typically require some type of pressure relief system external to the gerotor pump.

SUMMARY OF THE INVENTION

The present invention provides the advantage of combining the eccentric ring, the piston housing, and the gerotor pump pressure relief system all in one unit. This allows the advantage of less parts, less pressure loss due to fluid leakage, less wear between gerotor components and the piston housing, and the need for external pressure relief systems. These and other advantages of the present invention are provided by a gerotor pump comprising an inner rotor having a plurality of external teeth, an outer rotor having a plurality of internal teeth, and a one piece eccentric ring housing. The one piece eccentric ring housing has a first side opposite a second side and an aperture extending therethrough. The first side comprises an eccentric ring formed by an eccentrically positioned recess for housing the inner rotor and outer rotor. The second side comprises an annular recess forming a piston housing.

Other advantages and novel features of the present invention will become apparent in the following detailed description of the invention when considered in conjunction with the accompanying drawings.

DETAILED DESCRIPTION OF THE DRAWINGS

Figure 3:
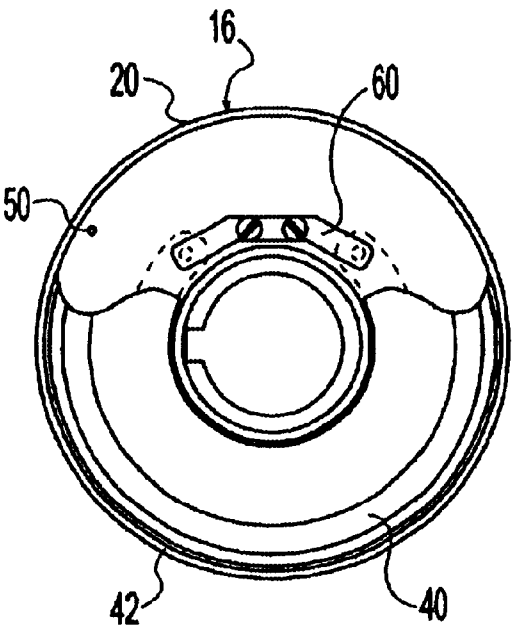
FIG. 3 is a bottom plan view of the gerotor pump of the present invention as shown in FIG. 1, including a cut away portion revealing the check valve and pressure relief mechanism.
Figure 2:
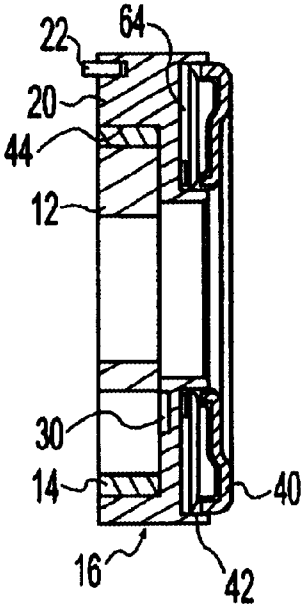
FIG. 2 is a cross-sectional side view taken across line 2—2 in FIG. 1 of the gerotor pump having a pressure chamber with an integral eccentric ring for a motor differential as shown in FIG. 1.
Figure 1:
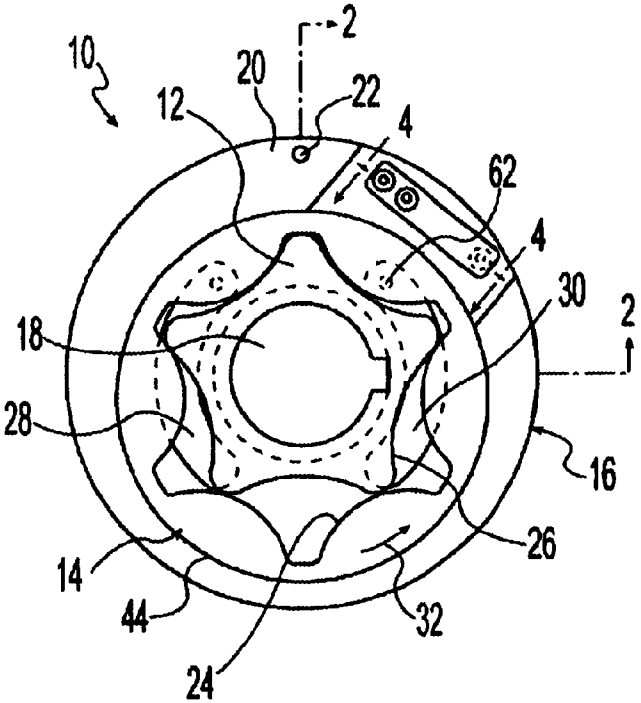
FIG. 1 is a top plan view of a gerotor pump having a pressure chamber with an integral eccentric ring for a motor differential in accordance with the present invention.

In the following detailed description of a preferred embodiment of the present invention, reference is made to the accompanying drawings which, in conjunction with this detailed description, illustrate and describe a non-reversing gerotor pump having a pressure chamber with an integral eccentric ring, also referred to as a one piece eccentric ring housing with integral piston housing, for a motor vehicle hydraulic differential, generally identified by reference number 10, in accordance with the present invention. Referring now to the drawings, in which like-referenced characters indicate corresponding elements throughout the several views, attention is directed to FIGS. 1 through 3, which illustrate a top plan view, a cross-sectional side view and a bottom plan view, respectively, of a gerotor pump having a pressure chamber with an integral eccentric ring for a motor vehicle hydraulic differential 10 of the present invention. Gerotor pump 10 comprises an inner impeller or rotor 12, an outer rotor 14, and eccentric ring housing 16. Inner rotor 12 includes central aperture 18 to permit inner rotor 12 to be positioned about and coupled to rotate with a shaft or some other rotating member, such as may be found in a motor vehicle axle differential, a four wheel drive motor vehicle transfer case center differential, or other similar devices.

Outer rotor 14 preferably includes a plurality of internal lobes or teeth 24. Inner rotor 12 preferably includes a plurality of external lobes or teeth 26 which are provided one less in number than the number of internal lobes or teeth 24 on outer rotor 14. In this manner, external teeth 26 of inner rotor 12 are engaged with only a portion of internal teeth 24 of outer rotor 14 at any particular time. Rotation of inner rotor 12 in relation to outer rotor 14 thus provides a series of variable volume chambers between external teeth 26 of inner rotor 12 and internal teeth 24 of outer rotor 14. Thus, rotation of inner rotor 12 in relation to outer rotor 14 causes fluid to be drawn into the enlarging chamber formed between external teeth 26 of inner rotor 12 and internal teeth 24 of outer rotor 14 and results in fluid being forced from the chamber as external lobes or teeth 26 of inner rotor 12 and internal teeth 24 of outer rotor 14 converge.

Figure 4:
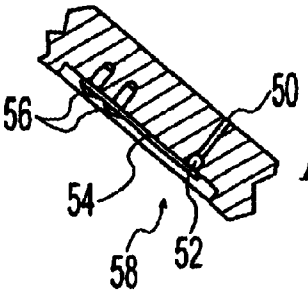
FIG. 4 is a cross-sectional view of the pressure relief mechanism of the gerotor pump of the present invention as shown in FIG. 1.

In the present invention, eccentric ring housing 16 comprises a first side having an integral eccentric ring 20 formed by an eccentrically positioned cylindrical recess or pocket 44 for housing inner rotor 12 and outer rotor 14, a second side forming an integral piston housing 42 for a piston 40, and a pressure relief passage 50 for use with a pressure limiting system 58 (see FIG. 4).

Operation of gerotor pump 10 is now discussed. Inlet chamber 28 is provided and may be connected through tubing or some other suitable conduit to a fluid sump or some other reservoir containing a quantity of fluid. Likewise, outlet chamber 30 is provided and is in fluid communication with a hydraulic piston 40 for the actuation thereof. In this manner, rotation of gerotor pump 10 in the direction of arrow 32 will draw fluid into the inlet chamber 28 and pressurize the fluid at the outlet chamber 30 such that the fluid is transferred to pressure chamber 64 through passage 62 and check valve 60. Pressure chamber 64 comprises the cavity formed by piston housing 42 and enclosed by moveable piston 40. The pressure in pressure chamber 64 increases proportionally to the rotational speed of the gerotor pump 10. Inlet check valve 60 allows flow from the outlet chamber 30 to the pressure chamber 64, the increased pressure in turn causes axial movement of piston 40 which causes the clutch of the hydraulic limited slip differential to engage (not shown). As hydraulic pressure continues to increases within pressure chamber 64, it forces the pressure relief valve assembly 58 to open and release the fluid. The pressure relief valve assembly 58 comprises fluid passageway 50 from the piston housing 42 on the second side of the eccentric ring housing 16 through to the first side of the eccentric ring housing 16 and specifically the integral eccentric ring 20. The pressure relief valve assembly 58 also comprises a check ball 52, biasing means represented by cantilever spring 54, and assembly screws 56. Cantilever spring 54 preloads check ball 52 into the end of passage 50 requiring the hydraulic fluid to generate a larger force to counteract the force created by the cantilever spring 54 so fluid is allowed to flow past the pressure relief valve assembly only when a sufficient pressure is achieved. When the gerotor pump 10 stops rotating, the hydraulic pressure decreases slowly due to sealing imperfections of the pressure relief valve assembly 58. These imperfections are typically caused by imperfections in surface finish which allow for slow leakage of fluid resulting in a reduction of the pressure inside the pressure chamber 64. This reduction in pressure allows the piston 40 to move axially in an opposite direction to allow the clutch of the hydraulic limited slip differential to disengage (not shown).

The eccentric ring housing 16 is restrained from rotating by an anti-rotation pin 22 such as a dowel pin pressed in outwardly eccentric ring 20 of eccentric ring housing 16 and mates with elements of the hydraulic limited slip differential for a motor vehicle (not shown). While the gerotor of the present invention is of the non-reversing eccentric ring type, it is used with a unidirectional fluid control system (not shown) of the type which are known in the art.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A gerotor pump assembly comprising:

an inner rotor having a plurality of external teeth;

an outer rotor having a plurality of internal teeth, the number of the internal teeth in the outer rotor being one greater in number than the number of the external teeth of the inner rotor; and a one piece eccentric ring housing having a first side opposite a second side and an aperture through the center thereof;

wherein the first side comprises a cylindrical housing body having an eccentric ring formed by an eccentrically positioned cylindrical recess for housing the inner rotor and outer rotor;

wherein the second side comprises an annular recess forming an annular piston housing.

2. The gerotor pump assembly of claim 1, wherein the a one piece eccentric ring housing further comprises a fluid passageway for a pressure limiting system.

3. The gerotor pump assembly of claim 2, wherein the pressure limiting system comprises a check ball and biasing means, wherein the biasing means pushes the check ball with a predetermined force against an end of the fluid passageway of the one piece eccentric ring housing.

4. The gerotor pump assembly of claim 3, wherein the biasing means comprises a metallic cantilever strip fastened at one end thereof to the one piece eccentric ring housing.

5. The gerotor pump assembly of claim 1, wherein the a one piece eccentric ring housing further comprises a recess for an anti-rotation pin.

6. The gerotor pump assembly of claim 1, wherein the gerotor pump is a non-reversing gerotor pump.

7. The gerotor pump assembly of claim 1 further comprising a piston moveably mounted within the piston housing of the second side of the one piece eccentric ring housing forming a pressure chamber between the piston and the piston housing of the one piece eccentric ring housing.

8. The gerotor pump assembly of claim 7, wherein the piston is formed as an annular ring positioned within the piston housing of the second side of the one piece eccentric ring housing.

9. The gerotor pump assembly of claim 1, further comprising a stop pin, wherein the stop pin is attached to and extends from the first side of the one piece eccentric ring housing.

10. A one piece eccentric ring housing for use with an inner and outer rotor of a gerotor pump assembly, comprising:

a first side opposite a second side;

wherein the first side comprises a circular housing body having an eccentrically positioned recess for housing the inner and outer rotor;

wherein the second side comprises an annular piston housing; and wherein the bottom of the eccentrically positioned recess includes an inlet chamber and an outlet chamber, the outlet chamber connected by a fluid passageway to the annular piston housing.

11. The one piece eccentric ring housing of claim 10 further comprising a second fluid passageway from the annular piston housing on the second side through the circular housing body of the first side.

12. The one piece eccentric ring housing of claim 11, wherein the second fluid passageway provides a passageway for a pressure limiting system.

13. The one piece eccentric ring housing of claim 10, wherein said first side includes a recess for a means for preventing rotation of the one piece eccentric ring housing when mounted in the hydraulic limited slip differential for a motor vehicle.

14. The one piece eccentric ring housing of claim 10 further comprising a location for a pressure limiting system.

15. A one piece eccentric ring housing for use with an inner and outer rotor of a gerotor pump assembly, comprising:

a cylindrical body having a first side opposite a second side and an aperture through the center thereof;

wherein the first side comprises an eccentric ring formed by an eccentrically positioned cylindrical recess for housing the inner and outer rotor;

wherein the second side comprises an annular recess forming a piston housing.

16. The one piece eccentric ring housing of claim 15, wherein the bottom of the eccentrically positioned cylindrical recess includes an inlet chamber and an outlet chamber, the outlet chamber connected by a fluid passageway to the annular piston housing.

17. The one piece eccentric ring housing of claim 16 further comprising a second fluid passageway from the annular piston housing on the second side through the circular housing body of the first side.

18. The one piece eccentric ring housing of claim 17, wherein the second fluid passageway provides a passageway for a pressure limiting system.

19. The one piece eccentric ring housing of claim 15, wherein said first side includes a recess for a means for preventing rotation of the one piece eccentric ring housing when mounted in the hydraulic limited slip differential for a motor vehicle.

20. The one piece eccentric ring housing of claim 15 further comprising a location for a pressure limiting system.

* * * * *